United States Patent [19]

Yoshimoto et al.

[11] 4,401,484

[45] * Aug. 30, 1983

[54] METHOD FOR HEAT TREATMENT OF METAL STRIPS

[75] Inventors: Hiromu Yoshimoto, Chita; Michitoshi Okumura, Kasugai; Kenji Kawate, Inuyama, all of Japan

[73] Assignees: Daidotokushuko Kabushikikaisha, Aichi; Sumitomo Kei Kinzoku Kogyo Kabushiki Kaisha, Tokyo, both of Japan

[ * ] Notice: The portion of the term of this patent subsequent to Sep. 8, 1998 has been disclaimed.

[21] Appl. No.: 225,224

[22] Filed: Jan. 15, 1981

[30] Foreign Application Priority Data

Jan. 18, 1980 [JP] Japan ..... 55-5112

[51] Int. Cl.³ ..... C22F 1/04

[52] U.S. Cl. ..... 148/131

[58] Field of Search ..... 148/13, 20.3, 131

[56] References Cited

U.S. PATENT DOCUMENTS 4,288,261 9/1981 Yoshimoto et al. ..... 148/131

*Primary Examiner*—R. Dean

*Attorney, Agent, or Firm*—William A. Ducker

[57] ABSTRACT

A method for the heat treatment of metal strips which comprises heating and cooling a metal strip while allowing the strip to pass through a heat treatment apparatus in a floating manner. When passing through the apparatus in such a manner, the strip is curved in the wave forms in the direction of feed thereof. Such curvatures given to the strip increase the resistance of the strip against buckling stress. The increased resistance of the strip against buckling stress is stronger than the thermal stress produced therein during the heating and cooling treatment so that the strip can be heated and cooled without any wrinkles produced therein.

5 Claims, 11 Drawing Figures

METHOD FOR HEAT TREATMENT OF METAL STRIPS

BACKGROUND OF THE INVENTION

1. Field of the Invention

This invention relates to a method for heat treatment such as annealing or the like of metal strips which comprises allowing a metal strip to pass through a heating zone and a cooling zone.

2. Description of the Prior Art

The usual method of heat treating metal strips (namely, long belt-shaped plates of aluminum, copper, iron, or the like obtained by continuous rolling using a rolling mill and normally having thicknesses of 3.5 mm or less and a variety of widths) is by allowing them to pass through a heating zone and a cooling zone in a floating manner. In this process, however, when the buckling stress resistance of the metal strip is weaker than the thermal stress produced in the strip in the transverse direction thereof, parallel wrinkles (FIG. 11) are formed in the strip in the travelling direction thereof, leading to the production of a defective treated product.

SUMMARY OF THE INVENTION

An object of the invention is to provide a method for heat treatment of metal strips which comprises allowing a metal strip to pass through a heating zone and a cooling zone in a floating manner and can produce a treated metal strip of excellent quality without any damage to the surface of the strip.

Another object of the invention is to provide a method for heat treatment of metal strips which make it possible to obtain a heat-treated metal strip without any wrinkles and of excellent quality even if the metal strip to be treated is of small thickness and would be likely to have wrinkles in the transverse direction of the strip if treated by the conventional method.

According to the invention, a metal strip to be treated is curved in the wave-like form when passing through a heating zone and a cooling zone. In addition, when passing the border between the heating and cooling zones and its vicinity (that is, the point of change of the temperature curve of the metal strip from an increasing or ascending direction to a decreasing or descending direction, and consequently the point of sudden occurrence of thermal stress), the metal strip is curved in a smaller radius of curvature at the portion passing the above-mentioned border than at the other curved portions. Therefore, it is possible to make the buckling stress resistance of the metal strip larger than the thermal stress produced in the strip at all times during the entire process of pssing the strip through the heating and cooling zones. Accordingly, metal strips which would be likely to have wrinkles in the transverse direction thereof if heat treated by the conventional method can be heat treated in a satisfactory manner (i.e., with no wrinkles produced in the strips) according to the invention.

A further object of the invention is to provide a method for heat treatment of metal strips which makes it possible to use a reduced motive power where any motive power is required for curving a metal strip for the entire process of passing the strip through a heating zone and a cooling zone.

In general, the smaller the radius of curvature to be given to a metal strip when curving the strip, the greater the motive power required for curving the strip.

According to the invention, the metal strip is curved to a smaller radius of curvature only at the portion where a sudden and great thermal stress occurs than at the other curved portions. Therefore, a great curving power is required only for the portion where a sudden and great thermal stress occurs.

Other objects and advantages of the invention will become apparent during the following discussion of the accompanying drawings.

BRIEF DESCRIPTION OF THE DRAWINGS

FIGS. 2 and 3 are shown with their right and left sides brought into line with those of FIG. 1);

DESCRIPTION OF THE PREFERRED EMBODIMENTS

Figure 1:
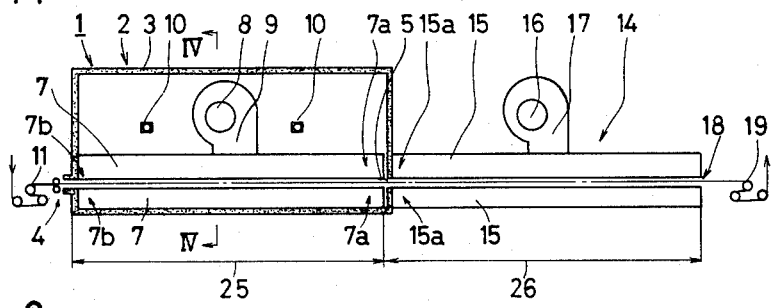
FIG. 1 is a schematic vertical section of a heat treatment apparatus.
Figure 4:
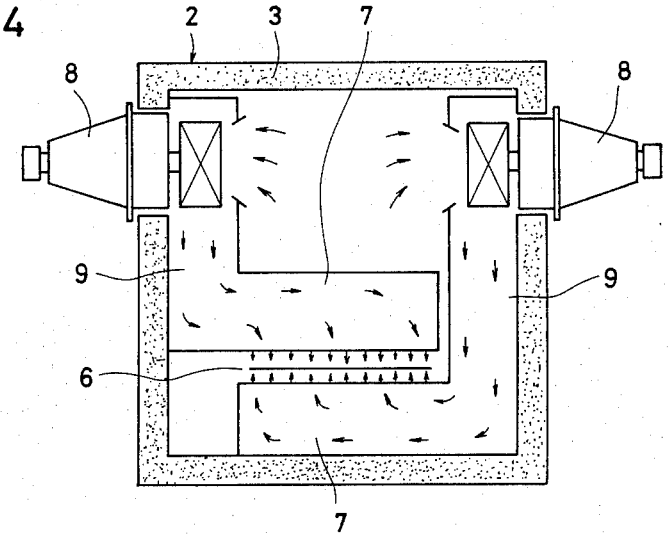
FIG. 4 is a cross section taken on the line IV—IV of FIG. 1.

Referring to FIG. 1, a heat treatment apparatus 1 comprises a heating device 2 and a cooling device 14. The heating device 2 (having a vertical section shown in FIG. 4) is defined by a furnace wall 3 which is adapted to prevent heat transfer between the inside and the outside of the heating device 2, as is well known in the art. The furnace wall 3 has an introducing opening 4 and an output opening 5 which are provided for inserting a metal strip 6 into the heating device 2 from the left side to the right side (in FIG. 1). Above and below a passage for the metal strip 6 in the heating device 2, plenum chambers 7,7 are provided opposite to each other. Each of the plenum chambers 7,7 has a plurality of strip curving means provided in the wall thereof adjacent to the metal strip 6 inserted into the heating device 2 and arranged over the entire length of the strip passage within the heating device 2. Air circulating fans 8,8 are installed on the furnace wall 3. The air circulating fans 8,8 are allowed to communicate with the plenum chambers 7,7, respectively, by means of air blast passages 9,9. Burners 10,10 are provided on the inner surface of the furnace wall 3. In front of the introducing opening 4 of the heating device 2, a plurality of rolls 11 are provided for introducing the metal strip 6 correctly into the introducing opening 4.

Since the cooling device 14 is constructed in a manner similar to that of the heating device 2 except that the former 14 has no furnace wall, no detailed explanation of the cooling device 14 is given here. In the cooling device 14, numerals 15,15 designate upper and lower plenum chambers each of which has a plurality of strip curving means provided in the wall thereof adjacent to the metal strip 6 inserted into the cooling device 14 and arranged over the entire length of the strip passage within the cooling device 14. Numerals 16, 17, 18 and 19 designate an air circulating fan, an air blast passage, a strip delivery port, and a plurality of delivery rolls, respectively.

Figure 5:
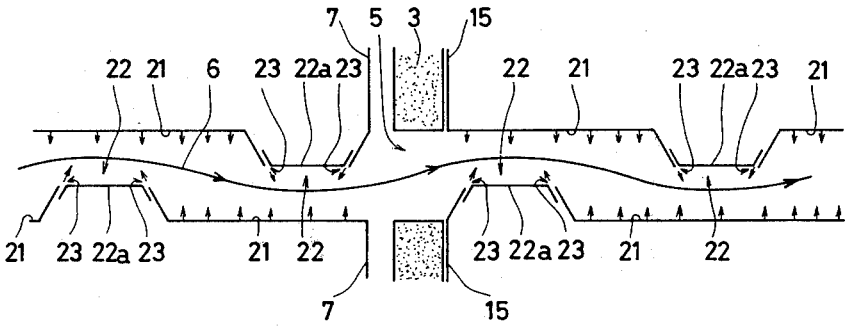
FIG. 5 is an enlarged view of a principal part of the apparatus of FIG. 1.

Explanation is then given to FIG. 5 which shows the strip curving means provided in the walls of the plenum chambers 7,7 (of the heating device 2) and 15,15 (of the cooling device 14) in detail. Numeral 21 designates nozzle faces, and dynamic-pressure nozzles are arranged in the walls of the plenum chambers 7,7 and 15,15 in the well-known manner so as to jet gas from the plenum chambers 7,7 against the metal strip 6 inserted into the apparatus 1. Numeral 22 designate static-pressure pad sections which are constructed in the same manner as in the conventional static-pressure pad, that is, so that gas from the plenum chambers 7,7 is jetted in directions indicated by arrows and strikes against the metal strip 6. A plurality of nozzles may also be provided at the walls **22*a* of the static-pressure pad sections 22 which face the strip passage, for additional jetting of gas against the metal strip 6. It is also possible that flat surfaces are used in place of the nozzle faces 21, and the metal strip 6 may be curved jets of gas only from the nozzles 23 of the static-pressure pad sections 22**.

Figure 7:
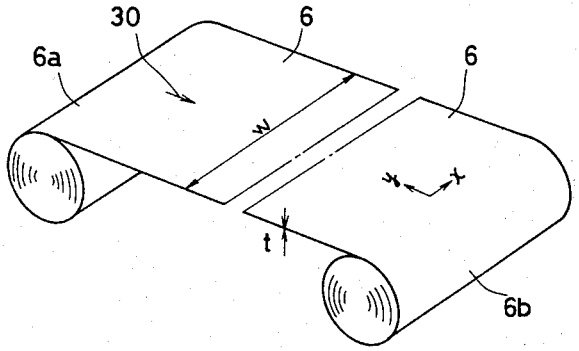
FIG. 7 shows the drawing out and rolling of an aluminum strip.

As shown in FIG. 7, the metal strip **6*a* rolled around a payoff reel as in the usual practice is drawn out as indicated by an arrow 30, and is allowed to pass through the well-known various mechanisms (not shown) and then through the heat treatment apparatus 1. Coming out of the apparatus 1, the metal strip is allowed to pass through the well-known various mechanisms (not shown and rolled round a rewind reel as indicated by numeral 6*b*** (as in the usual practice).

Figure 8:
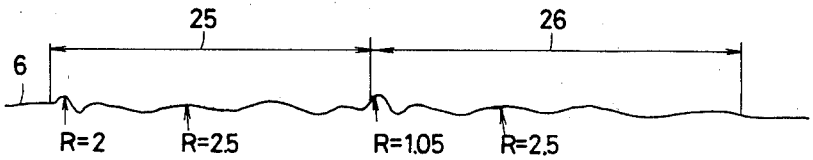
FIGS. 8 and 9 each show curvatures of a metal strip inserted into the apparatus of FIG. 1.

When the metal strip 6 is inserted into the apparatus 1, the burners 10,10 air circulating fans 8,8 and 16 are all operated. When the metal strip 6 is in the steady state, the strip 6 is allowed to pass through between the upper and lower plenum chambers 7,15 and 7,15 while floated and curved in the wave form by heated gas jetted from the nozzles provided in the walls of the plenum chambers 7,7 (of the heating device) and by air (not heated) jetted from the nozzles provided in the walls of the plenum chambers 15,15 (of the cooling device 14), as shown in FIG. 5. When passing the entrance section **7*b* (FIG. 1) of the heating device 2 and the border section 7*a*,15*a* (FIG. 1) between the heating device 2 and cooling device 14, the metal strip 6 is curved to a smaller radius of curvature than when passing the other portions in the apparatus 1 (i.e., the remaining portion of the strip passage), as shown in FIG. 8. The means such as air circulating fans 8,8,16,16 plenum chambers 7,7,15,15 and burners 10,10 in the apparatus 1 function in such manner that the metal strip 6** is treated as above mentioned and acquires heated and cooled characteristics as will be hereinafter explained.

After heated by passing through the heating device 2, the metal strip 6 passes through the cooling device 14 and is cooled thereby. In FIG. 1, numerals 25 and 26 designate a heating zone and a cooling zone, respectively.

Figure 2:
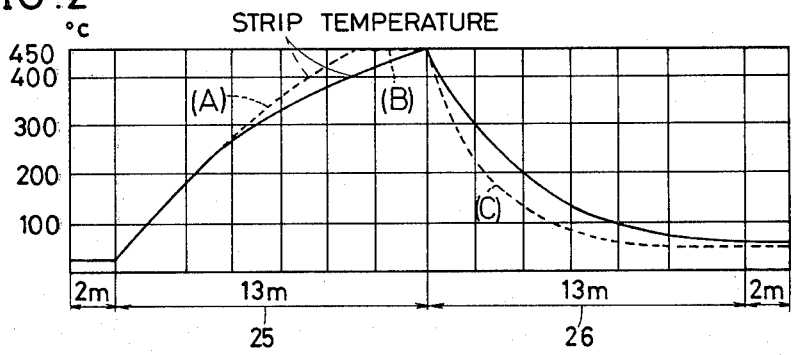
FIG. 2 is a graph showing a variation of temperature of a metal strip heat treated according to the invention.

FIG. 2 shows a variation of temperature of an aluminum strip heat treated as above mentioned by using the apparatus 1, both of the heating zone 25 and cooling zone 26 measure 13 meters in length and both of the lengths between the introducing rolls 11 and introducing opening 4 and between the strip delivery port 18 and delivery rolls 19 are 2 meters. The dimentions of the aluminum strip are 0.3 mm thickness and 2000 mm width.

Figure 3:
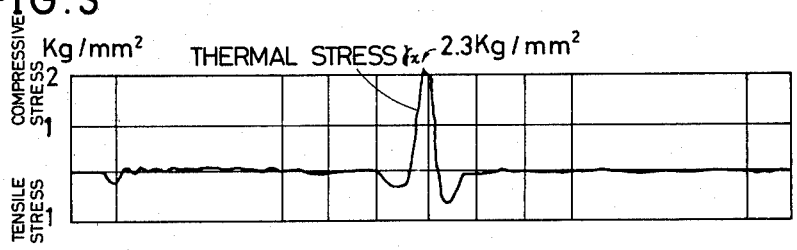
FIG. 3 is a graph showing a variation of thermal stress produced in a metal strip heat treated according to the the invention (Both

When the aluminum strip is heated and cooled as mentioned above, a thermal stress $\gamma x$ is produced at the center portion of the breadth of the strip in the direction of the breadth thereof, as shown in FIG. 3. However, since the strip is curved as mentioned above when treated, the buckling stress resistance of the strip in the direction of the breadth thereof is stronger than the thermal stress $\gamma x$. Therefore, the aluminum strip is not deformed by such thermal stress, but retains the original shape (except for curvatures made by gas jets) during treatment. As shown in FIG. 3, the thermal stress $\gamma x$ produced in the strip is greater at the entrance section **7*b* of the heating zone 25 and the border section 7*a*,15*a* between the heating zone 25 and cooling zone 26 than at the other portions thereof. However, since the strip is curved to smaller radii of curvature at these sections 7*b*,7*a*,15*a*** than at the other portions thereof, the buckling stress resistances of the strip are greater at these sections than at the other portions. Therefore, the buckling stress resistances of the strip at these sections also are stronger than the thermal stress thereof, so that the strip is not deformed by the thermal stress at these sections.

Figure 6:
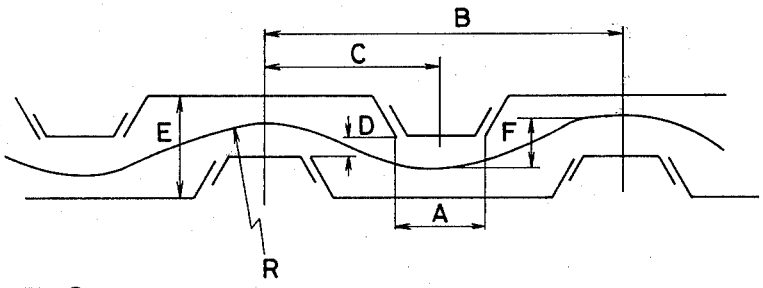
FIG. 6 is a cross section of a strip curving means of the apparatus of FIG. 1 shown for the purpose of indicating dimensions of the strip curving means.
Figure 10:
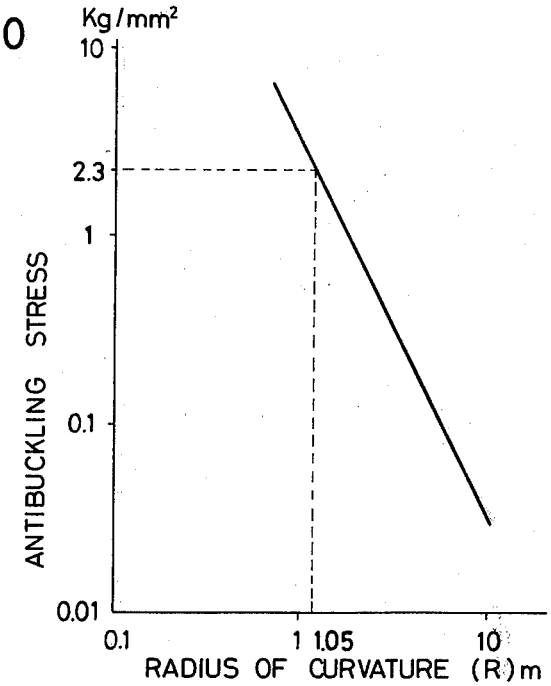
FIG. 10 is a graph showing the relationship between the radius of curvature and the buckling stress resistance of an aluminum strip heat treated according to the invention.
Figure 11:
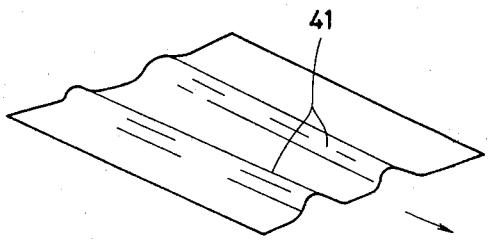
FIG. 11 shows wrinkles produced in a metal strip which has been heat treated by the conventional treatment method.

FIG. 10 shows the relationship between the radius of curvature and the buckling stress resistance of the abovementioned aluminum strip. In the heat treatment of FIGS. 2 and 3, the maximum thermal stress of the strip at the border section **7*a*,15*a* between the heating zone 25 and cooling zone 26 is 2.3 kg/mm$^2$ (FIG. 3). From FIG. 10, therefore, the maximum radius of curvature of 1.05 m can be obtained which gives rise to a buckling stress resistance capable of withstanding the above-mentioned maximum thermal stress. FIG. 6 shows the portion of the strip curving means which is located at the border section 7*a*,15*a***. In this portion, the dimensions A, B, C, D, E and F are 250 mm, 1,200 mm, 600 mm, 50 mm, 200 mm, and about 90 mm, respectively. The radius of curvature given to the strip in this portion is R (=1.05 m).

The radii of curvature of the portions of the strip other than that of the border section can be obtained in the same way as mentioned above. That is, the thermal stress produced in each portion of the strip and a graph showing the characteristics of the strip under the temperature of each portion thereof (i.e., graph similar to FIG. 10) are used. In the case of the above-mentioned aluminum strip, the radius of curvature of the portion at the entrance section **7*b* of the heating zone 25** is R=2 m, while the radii of curvature of all the other portions (except for the portion at the border section) are 2.5 m. These radii of curvature can be given to the strip by changing the dimensions B and C of each portion of the strip curving means in a suitable manner.

Figure 9:
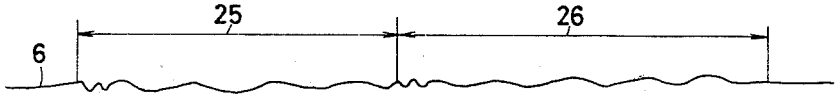

FIG. 9 shows a metal strip having curvatures different from those of FIG. 8 in amplitude. Such change in curvatures can be effected by changing the jetting pressure of gas of the nozzles.

When the amplitude of wave-like curvatures of a metal strip is changed (as from FIGS. 8 to 9), the pitches of the strip (i.e., distances between corresponding points on adjacent wave forms of the strip) required for obtaining the desired radii of curvature of the strip are changed. Change of the pitches of the strip can be made by changing any dimension or dimentions (shown in FIG. 6) of each portion of the strip curving means in a suitable manner.

In the case of FIG. 9, the metal strip is curved to a smaller radius of curvature (R=1.05 m) in three wave forms (curvatures) at the border section between the heating zone and cooling zone of the treatment apparatus. Such wave forms may be given to the strip by a dimension of, say, 10% to 15% of the total length of the heating and cooling zones.

The length and position of the portion of a metal strip where a great thermal stress occurs depend upon the heating conditions (temperature-rising incline) of the strip in the heating zone, the cooling conditions (temperature-lowering incline) of the strip in the cooling zone and the dimensions (width and/or thickness) and/or material of the strip.

The portion of a metal strip to which a smaller radius of curvature is to be given must be determined so that that portion of the strip coincides with the section of the strip where a greater thermal stress occurs. Therefore, if a greater thermal stress occurs in a metal strip over a great length, the portion of the strip to which a smaller radius of curvature is given must be over the corresponding great length. If the center (in the longitudinal direction) of the portion of a metal strip where a greater thermal stress occurs deviates from the border between the heating and cooling zones to be heating or cooling zone side, the portion of the strip to which a smaller radius is to be given must also be deviated accordingly.

The above-mentioned way of giving a smaller curvature of radius to a metal strip also applys when curving the strip to a smaller radius of curvature at the entrance section of the heating zone.

From one of the results of experiments carried on the energy consumption required for curving a metal strip according to the invention, electric power of an air blower is consumed by 82 when giving a metal strip a smaller radius of curvature (such as one shown in FIG. 8) at the border section between the heating and cooling zones and greater radii of curvature (such as those shown in FIG. 8) at all the other portions if electric power of an air blower is assumed to be consumed by 100 when giving a metal strip small radii of curvature such as above over the entire length of the heating and cooling zones. With regard to the electric power required for an air blower, therefore, the method of the invention makes possible an energy saving of about 20% compared with the energy consumption where the conventional heat treatment method is used.

It has been found out that when passing a metal strip through the apparatus 1 without giving any curvature to the strip except for at the border section between the heating and cooling zones, that is, passing the strip in a flat condition except for at the border section, the electric power required for the operation of an air blower is less than in the above-mentioned case, that is, 72. However, when passing a metal strip having a thickness of 0.3 mm or less through the apparatus in such manner, the portion of the strip which moves in a flat condition vibrates slightly, but rapidly, and the strip may be cut due to such vibration.

If desired, a metal strip may be hardened during the process of heat treatment by causing a temperature variation such as shown by a dashed line in FIG. 2 in the strip, that is, by raising the strip temperature as indicated by (A) in the heating zone, and maintaining the maximum temperature thereof for a while as indicated by (B) in the portion adjacent to the end of the heating zone 25, and lowering the strip temperature rapidly (e.g., at a rate of 100° C. or more per second) as indicated by (C) in the cooling zone 26. The rapid lowering of the strip temperature can be made by increasing the amount of air jetted from the plenum chambers 15,15 or by lowering the temperature of the air.

Alternatively, mist, water or hot water may be jetted against the strip for effecting a rapid lowering of the strip temperature.

If a metal strip is hardened during the process of heat treatment as mentioned above, temperature changes in the strip become extremely great, causing a thermal stress produced in the strip in the direction of breadth thereof to become greater. Therefore, if such hardening is effected to the strip during heat treatment, it is desired that the metal strip is curved to smaller radii of curvature so that the buckling stress resistance of the strip is stronger than the thermal stress thereof.

As many apparently widely different embodiments of the invention may be made without departing from the spirit and scope thereof, it is to be understood that the invention is not limited to the specific embodiments thereof except as defined in the appended claims.

What is claimed is:

1. In a method for the heat treatment of metal strips which includes steps of:

(i) passing a metal strip, in floating condition, successively through a heating zone and a cooling zone having a boundary zone between them, (ii) imparting to said strip, whilst passing through said heating, cooling and boundary zones, a wave-like form which extends longitudinally of the strip over the entire length of said zones, the improvement which comprises imparting to said strip, as it passes through said border zone, at least one wave-like form having a radius of curvature which is smaller than the respective radius of curvature of each other wave-like form imparted to said strip whilst within said heating zone and said cooling zone.

2. A method, as claimed in claim 1, wherein there is imparted to said strip, at an entrance portion to said heating zone, at least one wave-like form having a radius of curvature which is smaller than the respective radius of curvature of each other wave-like form imparted to said strip whilst within said heating zone and said cooling zone.

3. A method, as claimed in claim 1 or in claim 7, comprising the step of jetting gas against upper and lower faces of said strip in said heating zone and in said cooling zone in order to maintain said strip in floating condition.

4. A method, as claimed in claim 3, wherein said wave-like forms are imparted to said strip by applying respective strong jets and weak jets of gas to opposed faces of the strip at alternated positions along the longitudinal direction of the strip, each portion of the strip, having a strong jet of gas directed against one face thereof, having a weak jet of gas directed against the opposite face thereof.

5. A method, as claimed in claim 4, wherein said weak jets of gas are spaced longitudinally of the strip and emerge from a plate disposed parallel to the strip, and wherein said strong jets of gas are jetted from a static-pressure pad inflated towards said plate.

* * * * *